US006622323B2

(12) United States Patent
Zerhusen et al.

(10) Patent No.: US 6,622,323 B2
(45) Date of Patent: Sep. 23, 2003

(54) BED SIDERAILS HAVING FLEXIBLE PORTIONS

(75) Inventors: Robert Mark Zerhusen, Cincinnati, OH (US); David W. Hornbach, Brookville, IN (US); David W. Hensley, Milan, IN (US); Gerald D. Eckstein, Batesville, IN (US); Francis Ganance, Batesville, IN (US); Dennis E. Geiling, Brookville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 124 days.

(21) Appl. No.: 09/815,697

(22) Filed: Mar. 23, 2001

(65) Prior Publication Data

US 2001/0054199 A1 Dec. 27, 2001

Related U.S. Application Data

(60) Provisional application No. 60/191,924, filed on Mar. 24, 2000.

(51) Int. Cl.[7] ..... A47C 21/08; A47C 31/00

(52) U.S. Cl. ..... 5/427; 5/424; 5/663; 5/428

(58) Field of Search ..... 5/424, 425, 427, 5/428, 663

(56) References Cited

U.S. PATENT DOCUMENTS

| | | | | | |
|---|---|---|---|---|---|
| 1,938,635 | A | * | 12/1933 | North | 5/427 |
| 3,063,066 | A | | 11/1962 | Peck et al. | |
| 3,220,024 | A | * | 11/1965 | Nelson | 5/429 |
| 3,851,345 | A | | 12/1974 | Benoit et al. | |
| 4,437,704 | A | * | 3/1984 | Hovsepians | 5/490 X |
| 4,523,745 | A | * | 6/1985 | Killman et al. | 5/424 X |
| 5,035,014 | A | | 7/1991 | Blanchard | |
| 5,084,925 | A | | 2/1992 | Cook | |
| 5,345,629 | A | | 9/1994 | Ferrand | |
| 5,450,641 | A | * | 9/1995 | Montgomery | 5/663 |
| 5,469,591 | A | * | 11/1995 | Nomura | 5/613 |
| 5,481,772 | A | | 1/1996 | Glynn et al. | |
| 5,700,053 | A | * | 12/1997 | Downing | 297/227 |
| 5,732,423 | A | | 3/1998 | Weismiller et al. | |
| 5,832,549 | A | | 11/1998 | Le Pallec et al. | |
| 5,890,244 | A | * | 4/1999 | Cartwright et al. | 5/663 |
| 5,934,754 | A | * | 8/1999 | Raffa | 297/392 |
| 6,038,721 | A | * | 3/2000 | Gordon | 5/663 |
| 6,347,422 | B2 | * | 2/2002 | Heavrin | 5/425 X |
| 6,401,281 | B1 | * | 6/2002 | Younge | 5/425 X |

FOREIGN PATENT DOCUMENTS

| | | | | |
|---|---|---|---|---|
| GB | 2136280 | * | 9/1984 | 5/424 |

* cited by examiner

*Primary Examiner*—Jong-Suk (James) Lee
(74) *Attorney, Agent, or Firm*—Timothy E. Niednagel; Bose McKinney & Evans LLP

(57) ABSTRACT

A bed siderail for a bed having a frame includes a flexible section to allow a portion of the siderail to flex upward.

43 Claims, 14 Drawing Sheets

BED SIDERAILS HAVING FLEXIBLE PORTIONS

This application claims the benefit of U.S. Provisional Application Ser. No. 60/191,924, filed Mar. 24, 2000, the disclosure of which is incorporated herein by reference.

BACKGROUND AND SUMMARY OF THE INVENTION

The invention relates to bed siderails, and, more particularly, to bed siderails with flexible portions.

Hospital beds often have siderails to reduce the likelihood that convalescing patients will inadvertently fall out of their beds. The siderails are usually constructed from metal or a similarly rigid material such as a stiff plastic or polymer, and may be raised and lowered vertically to accommodate a patient moving into and out of the hospital bed.

Hospital beds also often have a head section of the bed that may be pivoted upwardly about a transverse pivot axis to allow the patient to move to a sitting position. It is desirable to simultaneously pivot the siderails adjacent to the head section of the bed upwardly with the head section of the bed. To accommodate raising the siderails in this manner, the siderails are typically divided into two sections, a head section and a body section. The head section and body section siderails must be spaced apart at the transverse pivot axis to allow the head section siderail to pivot without impinging the stationary body section siderail. Therefore, a gap is created between the head section siderail and the body section siderail.

Thus, there is a need for a bed siderail of unitary construction which eliminates the gap between conventional siderails. The bed siderail of the present invention includes a flexible portion to allow a portion of the siderail adjacent the head section of the bed to pivot upwardly with the head section of the bed, while body section of the siderail remains substantially stationary.

According to the present invention, a siderail is provided for a bed having a frame and a head deck section coupled to the frame. The head deck section is movable relative to the frame from a generally horizontal position to an elevated position. The siderail includes an elongated flexible member having a longitudinal axis, a first end portion, and a second end portion. The first end portion is coupled to the head deck section so that the flexible member bends in a first direction relative to its longitudinal axis when the head deck section is in its elevated position.

Also according to the present invention, the flexible member bends in a second direction relative to its longitudinal axis when the head deck section is in its generally horizontal position.

In the illustrated embodiment, a lifting mechanism is coupled to the frame and to the second end portion of the flexible member. The lifting mechanism is configured to raise and lower the flexible member relative to the frame. A locking mechanism is illustratively coupled to the lifting mechanism and a release handle coupled to the locking mechanism. Actuation of the release handle releases the locking mechanism and permits movement of the lifting mechanism and the flexible member relative to the frame. The illustrated embodiment also includes an extendible section located along the longitudinal axis of the flexible member and capable of extending and retracting along the longitudinal axis of the flexible member.

Also according to the present invention, a siderail is provided for a bed including a patient support surface having opposite first and second sides, a head end, and a foot end spaced apart from the head end to define a length dimension of the patient support surface therebetween. The siderail includes first and second elongated flexible members coupled to the bed and extending along the first and second sides, respectively. The first and second flexible members illustratively extend for at least fifty percent of the length dimension of the patient support surface. The siderail also includes first and second lifting mechanisms coupled to the bed adjacent the first and second sides, respectively. The first and second lifting mechanisms also are coupled to the first and second flexible members, respectively, to raise and lower the first and second flexible members relative to the patient support surface.

Another illustrated embodiment of the invention includes a siderail for a bed having a frame and an elevating section coupled to the frame, the elevating section having a raised position and a lowered position. The siderail includes an elongated flexible member having a longitudinal axis, a first end portion, and a second end portion. The first end portion is coupled to the elevating section so that the flexible member bends in a first direction relative to its longitudinal axis when the elevating section is in its raised position.

Another illustrative embodiment of the invention includes a siderail covering for a bed siderail having flexible portions and extendible portions. The siderail covering includes a material configured to flex along the flexible portion of the bed siderail and compress along the extendible portion of the bed siderail. The material including a plurality of compressible regions, and defines an central aperture configured to receive the bed siderail.

Also according to the invention, the siderail covering material further defines a seam extending from the outer surface of the siderail cover to the central aperture.

Additional features of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
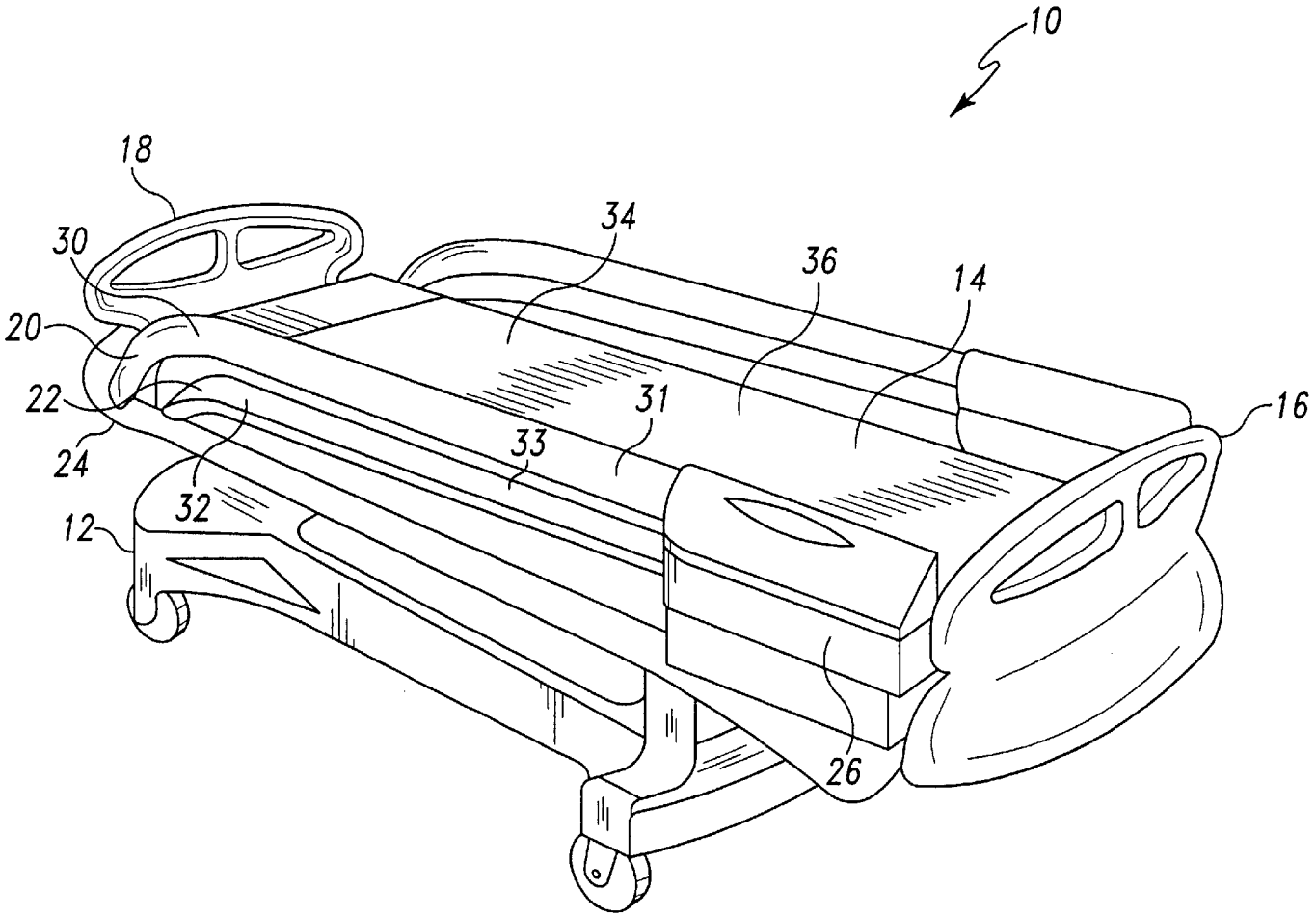
FIG. 1 is a perspective view of a hospital bed including bed siderails having a flexible portion, with a head deck section of the bed in a lowered position.

As shown in FIG. 1, a hospital bed 10 comprises a bed frame 24 supported by a base 12. Footboard 16 and headboard 18 are attached to bed frame 24. A first siderail 20, a second siderail 22 and a lifting mechanism 26 are located on each side of the bed 10 to restrain movement of a patient past opposite side edges of a first and second siderails 20 and 22 are pivotally attached to head deck section 34, and lifting mechanism 26 is rigidly attached to bed frame 24. First siderail 20 includes a flexible section 30 and an extendible section 31. Likewise, second siderail 22 includes a flexible section 32 and an extendible section 33.

Figure 2:
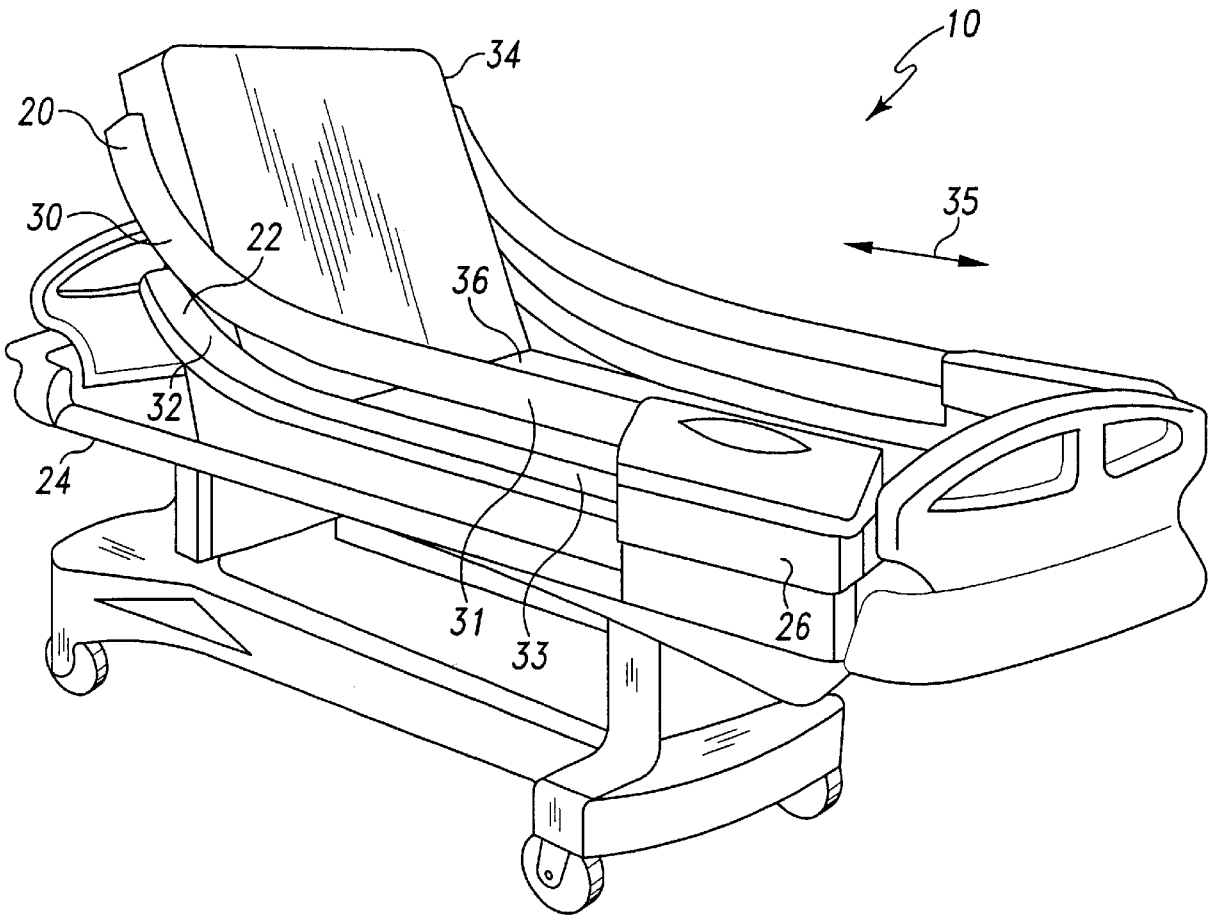
FIG. 2 is a perspective view of the hospital bed of FIG. 1 illustrating the head deck section of the bed in a raised position.

In FIG. 2, head section 34 of the deck is pivoted upwardly relative to frame 24 and body section 36 of the deck. Flexible sections 30 and 32 of first and second siderails 20 and 22 articulate upwardly with head section 34 of the deck while the extendible sections 33 and 34 of first and second siderails 20 and 22 remain in a horizontal orientation substantially parallel to a longitudinal axis of the hospital bed 10. Due to the curvature of flexible sections 30 and 32 of siderails 20 and 22, the length of extendible sections 31 and 33 varies as head section 34 of the deck is raised or lowered. Extendible sections 31 and 33 expand and contract in length in the direction of the double-headed arrow 35.

Figure 3:
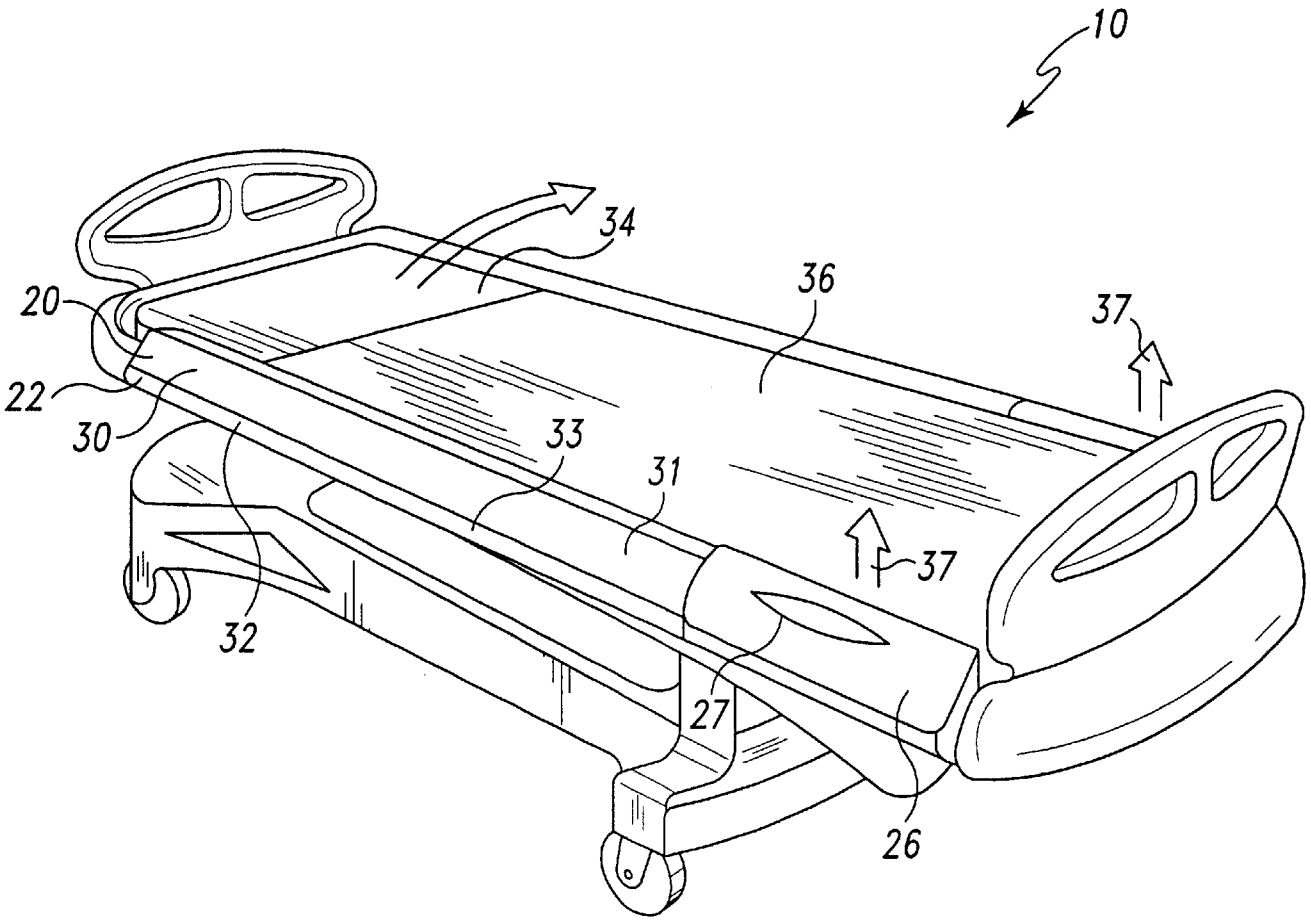
FIG. 3 is a perspective view of the hospital bed of FIGS. 1 and 2 illustrating both the head deck section of the bed and the bed siderails in a lowered position.

First and second siderails 20 and 22 may be raised and lowered vertically through operation of lifting mechanism 26. In FIG. 3, a caregiver raises first and second siderails 20 and 22 by actuating a release mechanism on a handle 27 of the lifting mechanism 26 and pulling upwardly in the direction of arrow 37. The lifting mechanism 26 is then placed in a locked position so that the first and second siderails 20 and 22 extend vertically above the plane of the patient support surface 14, as shown in FIG. 1. Due to the curvature of flexible sections 30 and 32 of siderails 20 and 22, the length of extendible sections 31 and 33 varies as lifting mechanism 26 is raised or lowered.

Figure 4:
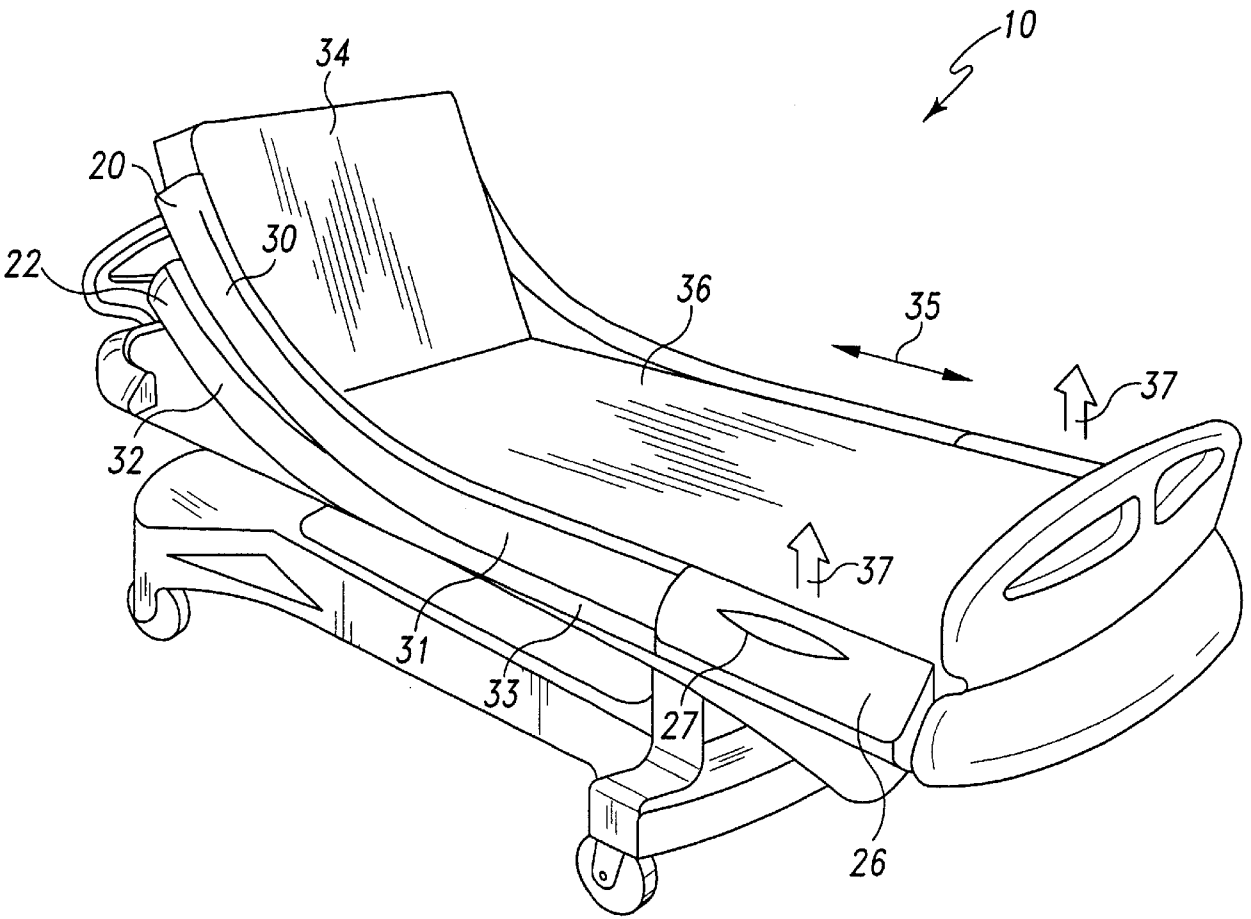
FIG. 4 is a perspective view of the hospital bed of FIGS. 1–3 illustrating the head deck section of the bed in a raised position and the bed siderails in a lowered position.

First and second siderails 20 and 22 may also be raised and lowered vertically through operation of lifting mechanism 26 when head section 34 of the deck is in the elevated position of FIG. 4. In FIG. 4, a caregiver raises first and second siderails 20 and 22 by actuating the release mechanism on the handle 27 of lifting mechanism 26 and pulling upwardly in the direction of arrow 37. The lifting mechanism 26 is then placed in a locked position and first and second siderails 20 and 22 are positioned as depicted in FIG. 2.

Figure 7:
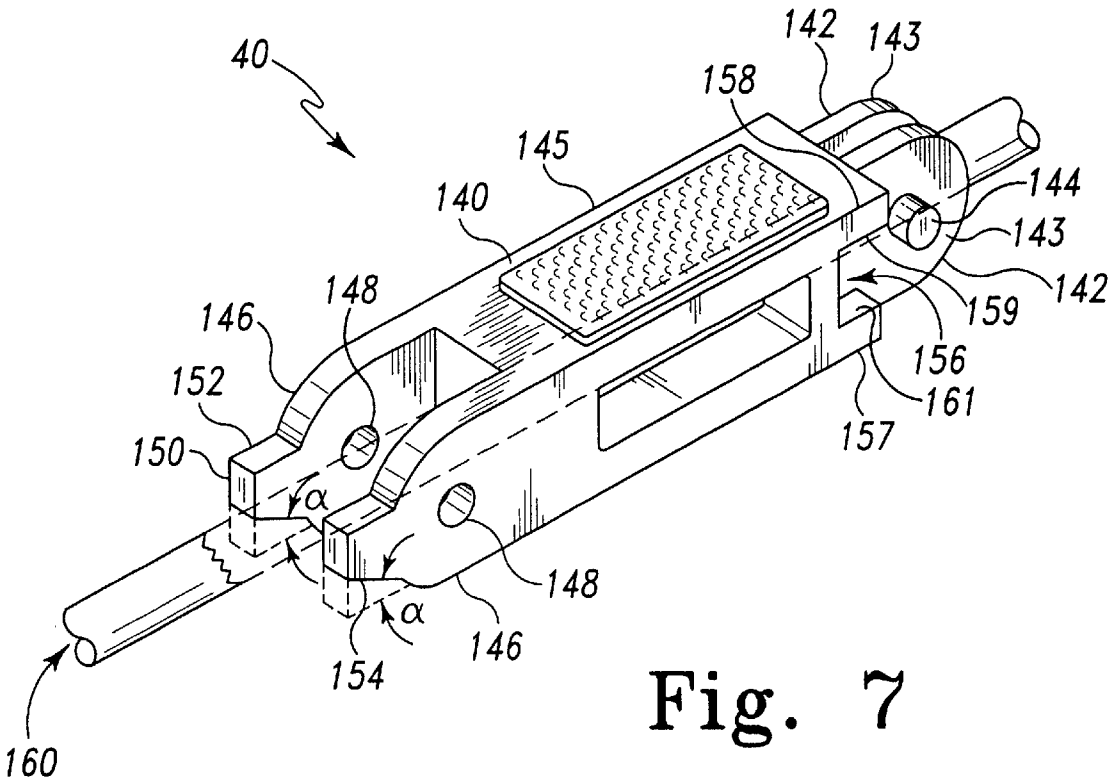
FIG. 7 is a perspective view of a flexible siderail link and semi-flexible rod extending through a bore formed in the link.
Figure 6:
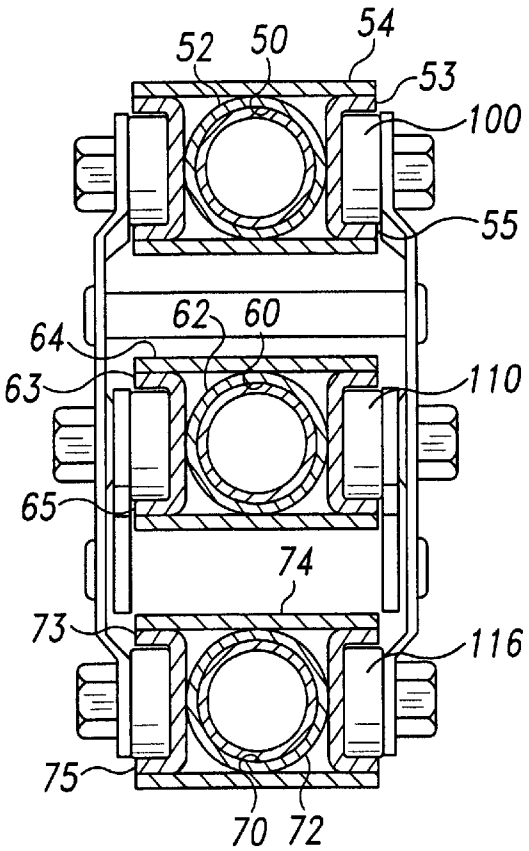
FIG. 6 is a cross sectional view taken along lines 6—6 of FIG. 5 further illustrating the lifting mechanism and extendible sections.
Figure 12:
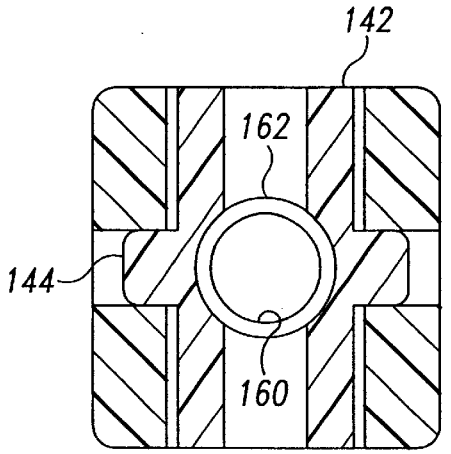
FIG. 12 is a cross sectional view of two mated links.

The flexible sections 30 and 32 of first and second siderails 20 and 22 are illustratively formed by a plurality of interconnected links 40. As shown in FIG. 7, each link 40 comprises a pair of proximately spaced inner link plates 142, each inner link plate 142 having a pin 144 extending from an outer surface 143 of the inner link plate 142. The pins 144 extend outwardly perpendicularly from the longitudinal axis of the link 40. Proximately spaced from each inner link plate 142 is a receiver space 156 defined by spaced apart blocks 157 and 158. The other end of the link 40 comprises a pair of outer link plates 146. Plates 146 are each formed to include an aperture 148. Distal prongs 150 are defined by a first wall 152 which extends substantially parallel to the longitudinal axis of link 40, and a second wall 154 extending at a varying angle $\alpha$ measured vertically from the longitudinal axis of link 40. As shown in FIG. 12, a semi-flexible rod 160 extends through a central bore 162 formed in the link 40 for the entire length of the siderail. The semi-flexible rod 160 slides freely through bore 162.

Inner link plates 142 are pivotally coupled to outer link plates 146 of an adjacent link 40 by inserting pins 144 through apertures 148. Distal prongs 150 extend into receivers 156 of an adjacent link 40 and limit the range of motion of the connected links 40 provided by the pivotal coupling of inner link plates 142 and outer link plates 146.

Figure 8:
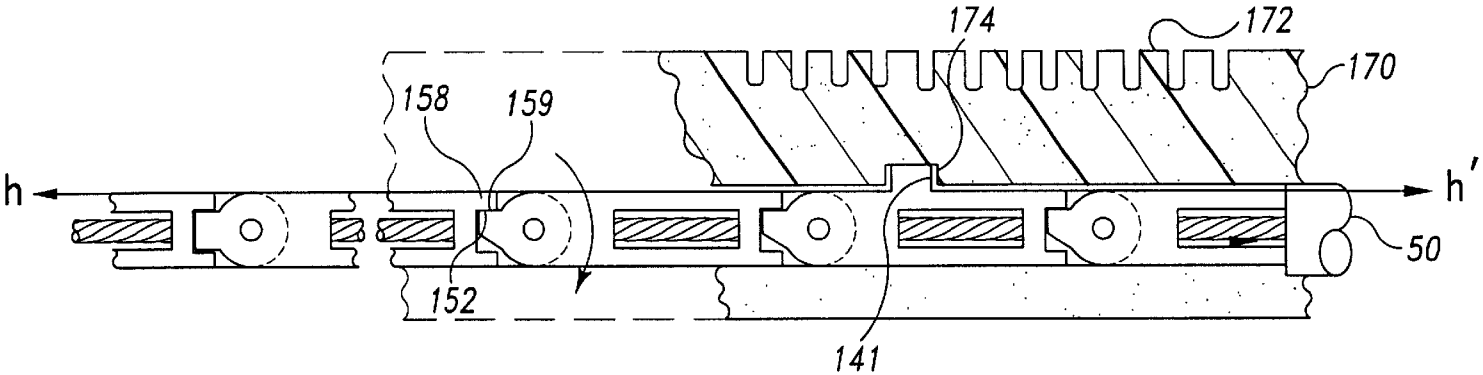
FIG. 8 is a side elevational view showing a portion of the siderail having a plurality of links embedded in siderail material, the siderail material being cut to permit the siderail material to bend to accommodate curvature of the links.

First wall 152 limits rotation in a first direction by abutting an inner surface 159 of block 158, as shown in FIG. 8. Because first wall 152 is substantially parallel to the longitudinal axis of link 140, the articulation of a plurality of interconnected links 40 is limited such that the plurality of interconnected links 140 may not extend substantially below the horizontal plane h–h' as shown in FIG. 8.

Figure 10:
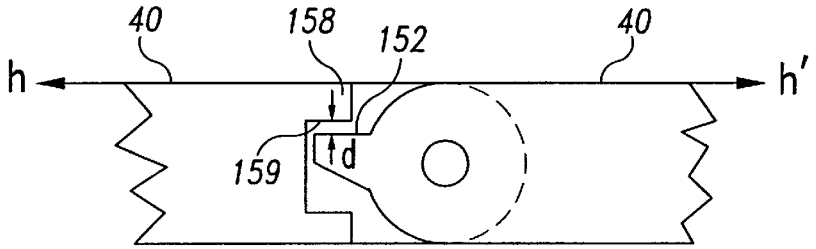
FIG. 10 is a side elevational view illustrating portions of two interconnected links.
Figure 11:
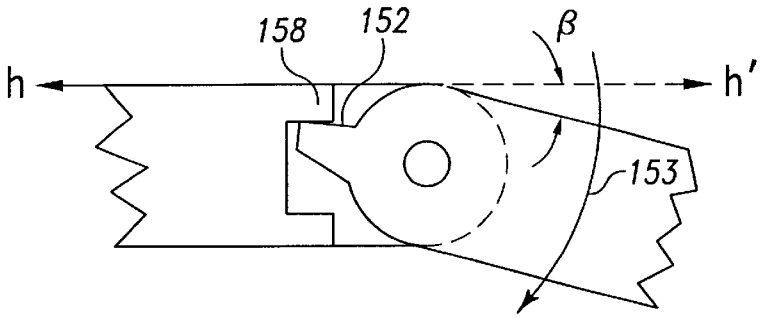
FIG. 11 is a side elevational view illustrating the rotational range between the two links of FIG. 10.

Alternatively, a spacing tolerance d is provided as shown in FIG. 10. First and second links 40 are positioned parallel to horizontal plane h–h'. Spacing tolerance d is selected such that rotation in a first direction as indicated by arrow 153 in FIG. 11 may extend below the horizontal plane h–h' by an angle $\beta$. The spacing tolerances is varied to allow for more abrupt downward curvature of first and second siderails 20 and 22 near the pivotal connections to head section 34 of the deck. Of course, first wall 152 may also extend at an angle similar to second wall 154 rather than extending parallel to the longitudinal axis of link 40.

Figure 9:
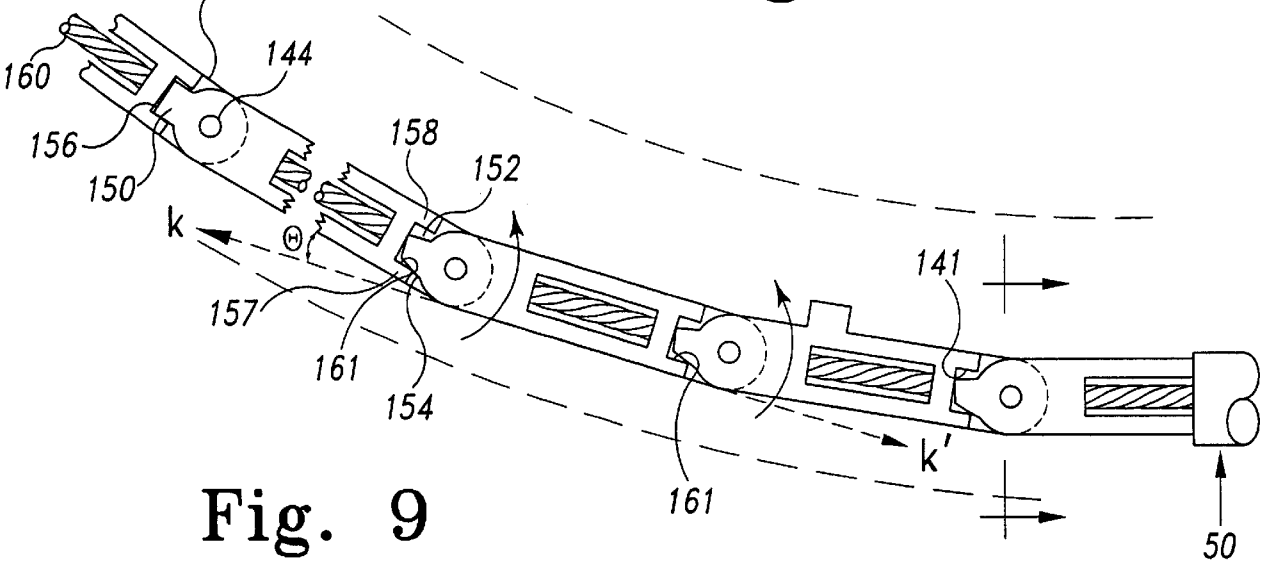
FIG. 9 is a side elevational view illustrating the plurality of links in a curved configuration.

Second wall 154 limits rotation of the links 40 in a second direction by abutting an inner surface 161 of block 157, as shown in FIG. 9. Angle $\alpha$ varies depending upon the location of link 40 in the siderail 20, 22 to permit curvature of interconnected links 40 above horizontal plane k–k'. A larger angle $\alpha$ results is in a larger angle of curvature $\theta$ above plane k–k' as shown in FIG. 9. Angle $\alpha$ is selected to allow for more abrupt upward curvature of first and second siderails 20 and 22 near the pivotal connections to head section 34 of the deck.

As will be readily appreciated by one of ordinary skill in the art in considering the above descriptions of the illustrative embodiment disclosed, other embodiments of links 40 are within the scope and spirit of the invention. For example, links 40 may comprise a pivotal joint member which provides rotation relative to planes h–h' and k–k' while restricting rotation within those planes.

Figure 14:
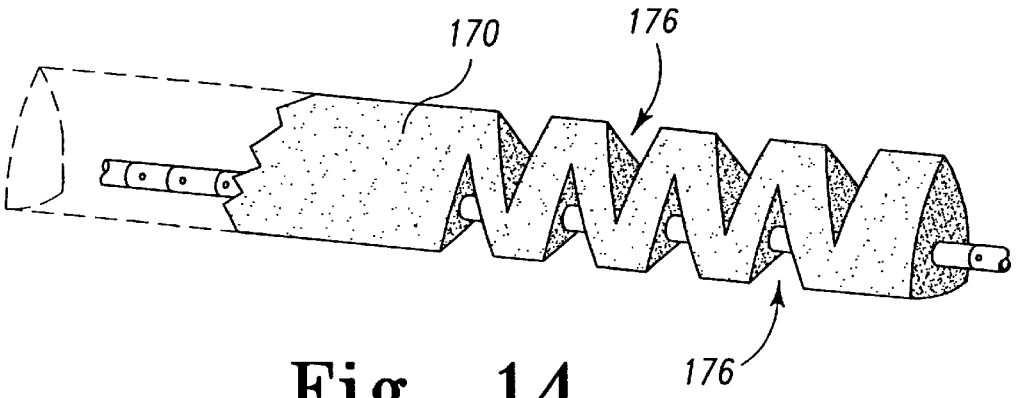
FIG. 14 is a perspective view of siderail material with a series of v-cuts to permit the material to be extended and retracted.

Siderail material 170 covers links 40 and rod 50. Siderail material 170 is illustratively made from a soft, compressible material that freely flexes along the articulation path of the plurality of links 40 as shown in FIG. 9. Compression teeth 172 are cut into the top of siderail material 170 to provide consistent bending of siderail material 170 without buckling. A series of interlaced bellow apertures comprising v-shaped cuts 176 form compressible regions as shown in FIG. 14 also accommodate flexure and compression of the siderail material. The siderail material 170 is illustratively covered by a flexible, waterproof fabric shell, such as nylon or similar material.

A mating surface 140 is provided on the link 40 to engage a corresponding surface on the siderail material 170 and thereby prevent the siderail material 170 from sliding along or rotating around the plurality of links 40. In FIG. 7, the mating surface is a Velcro material. Alternatively, a mating extension or fin 141 extends upwardly from link 40 and enters a slot 174 formed in the siderail material 170, as shown in FIG. 8. Mating extensions may also extend horizontally from link 40. It is understood that other suitable fasteners such as, for example, snaps, ties, or adhesives may be used to secure the siderail material 170 to the links 40.

Figure 13:
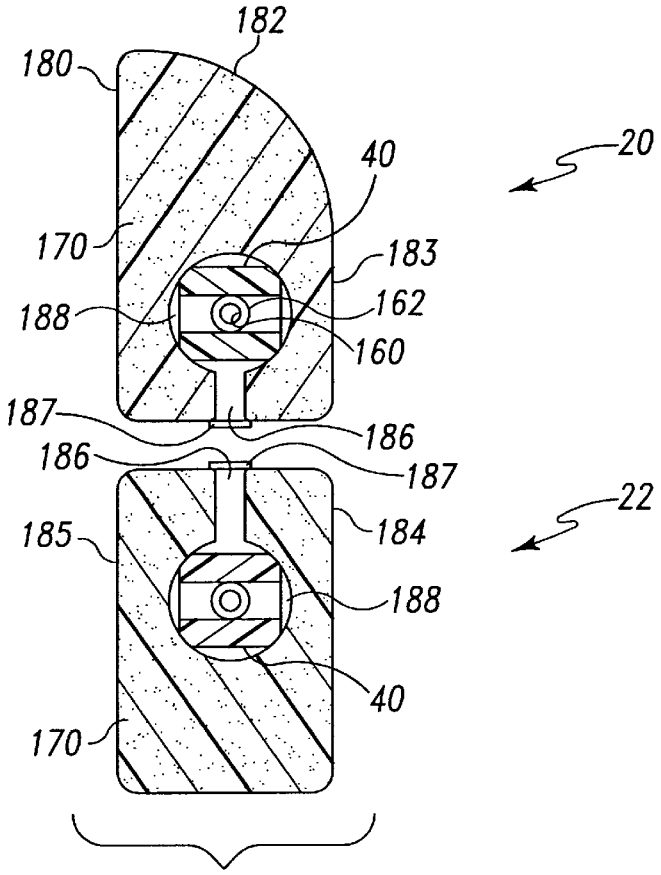
FIG. 13 is a cross sectional view illustrating an upper and a lower flexible siderail.

Siderail material 170 for the first and second siderails 20 and 22 may also differ in cross-sectional geometry, as shown for example in FIG. 13. First siderail 20 has an interior surface 180 adjacent the patient support surface 14 of the hospital bed 10. An exterior curved surface 182 extends downward, forming exterior planar surface 183. Links 40 are housed within cavity 188.

Seam 186 is provided to readily remove and attach the siderail material 170 to the links 40. Couplings 187 secure the seam 186 when the siderail material 170 is attached to links 40. Couplings 187 are realized by any number of couplings known to those of ordinary skill in the art, including snap attachments, Velcro attachments, or a zipper extending the length of the seam 186.

Second siderail 22 has siderail material 170 having an exterior planar surface 184 and an interior planar surface 185. Links 40 are housed within cavity 188. Seam 186 is provided to readily remove and attach the siderail material 170 to the links 40.

Figure 5:
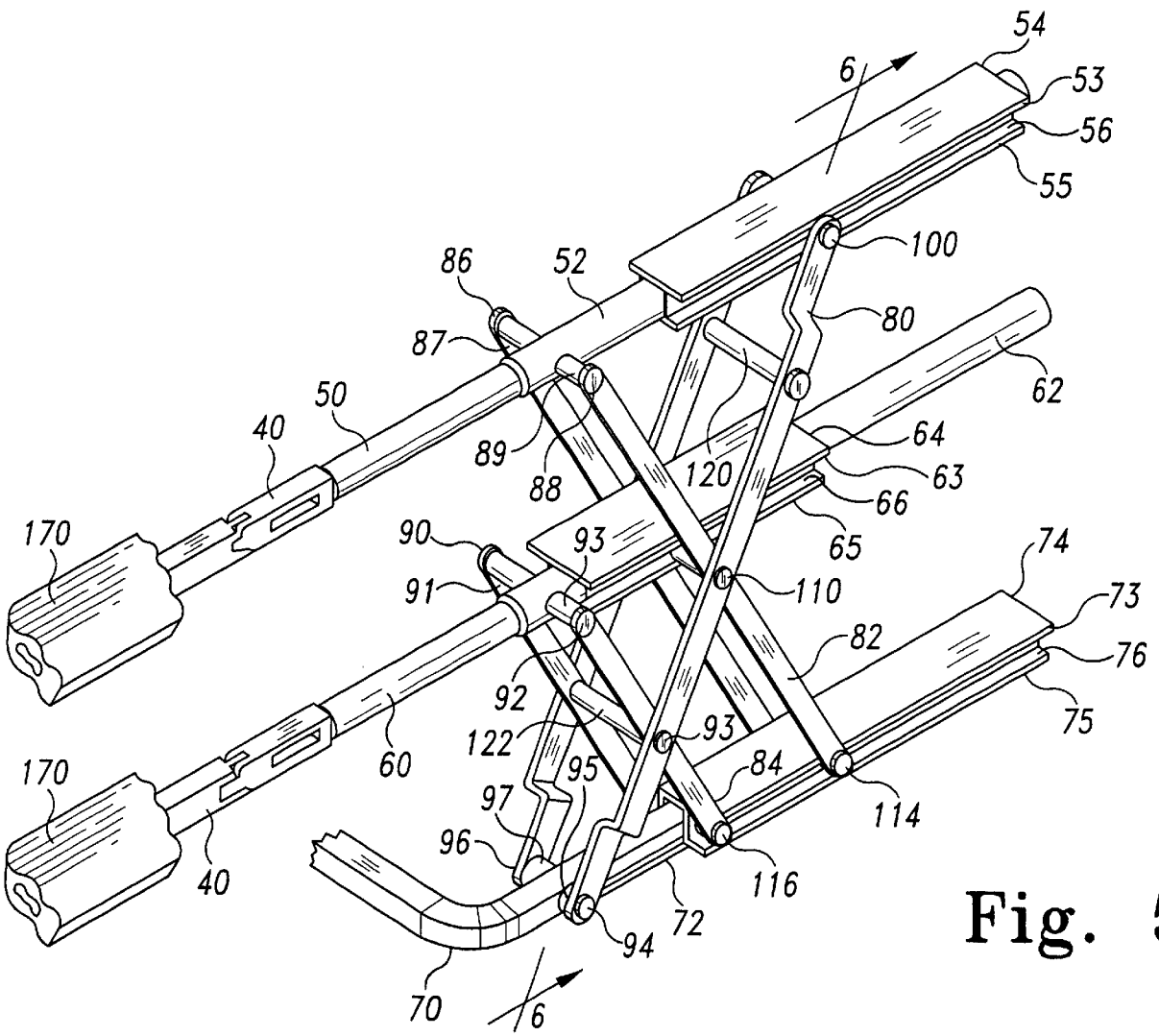
FIG. 5 is a perspective view of a lifting mechanism and first and second extendable sections of the bed siderail.

The extendible sections 31 and 33 of flexible siderails 20 and 22, and the lifting mechanism 26 are illustrated in FIG. 5. A link 40 of first siderail 20 is coupled to the first rod 50. First rod 50 is inserted into first cylinder 52 and slides freely within first cylinder 52. First cylinder 52 is rigidly connected to first cylinder housing 54, which extends distally along cylinder 52. Upper flange 53 and lower flange 55 define a bearing track 56. Pins 86 and 88 are inserted into sleeves 87 and 89 extending perpendicularly into the horizontal plane from the longitudinal axis of first cylinder 52.

Similarly, a link 40 of second siderail 22 is coupled to second rod 60. Second rod 60 is inserted into second cylinder 62 and slides freely within second cylinder 62. Second cylinder 62 is rigidly connected to second cylinder housing 64, which extends toward sleeves 91 and 93 on first cylinder 62. Upper flange 63 and lower flange 65 define a bearing track 66. Pins 90 and 92 are inserted into sleeves 91 and 93 extending perpendicularly into the horizontal plane from the longitudinal axis of second cylinder 62.

A third cylinder housing 74 provides a base for the scissors lift apparatus 26. A scissors anchor 70 attaches a third cylinder 72 to bed frame 24. Third cylinder 72 is rigidly connected to third cylinder housing 74, which extends distally along cylinder 72. Upper flange 73 and lower flange 75 define a bearing track 76. Pins 94 and 96 are inserted into sleeves 95 and 97 extending perpendicularly into the horizontal plane from the longitudinal axis of third cylinder 72.

A first pair of scissors links 80 is rotatably connected at one end to pins 94 and 96. A second pair of scissors links 82 is rotatably connected at one end to pins 86 and 88. A third pair of scissors links 84 is rotatably connected at one end to pins 90 and 92. The first pair of scissors links 80 and second pair of scissors links 82 are rotatably coupled by bearing member 110, which, in turn, slides freely in bearing track 66. Second brace 122 rotatably couples first pair of scissors links 80 to third pair of scissors links 84. First brace 120 also couples both members of the first pair of scissors links 120 together for added transverse support. The first pair of scissors links 80 is also rotatably coupled to bearing members 100, which, in turn, slides freely in bearing track 56. The second and third pairs of scissors links 82, 84 are also rotatably coupled by bearing members 114 and 116, respectively, both of which, in turn, slide freely in bearing track 76.

Raising or lowering the scissors lifting apparatus 26 causes the first, second and third pairs of scissors links 80, 82 and 84 to rotate about pins 94 and 96, 86 and 88, and 90 and 92, respectively, and cooperatively slide through bearing tracks 56, 66 and 76. Bearing members 100, 110, 114 and 116 may either be wheeled members or fixed nylon bearing surfaces engaging bearing tracks 56, 66, and 76.

Figure 15:
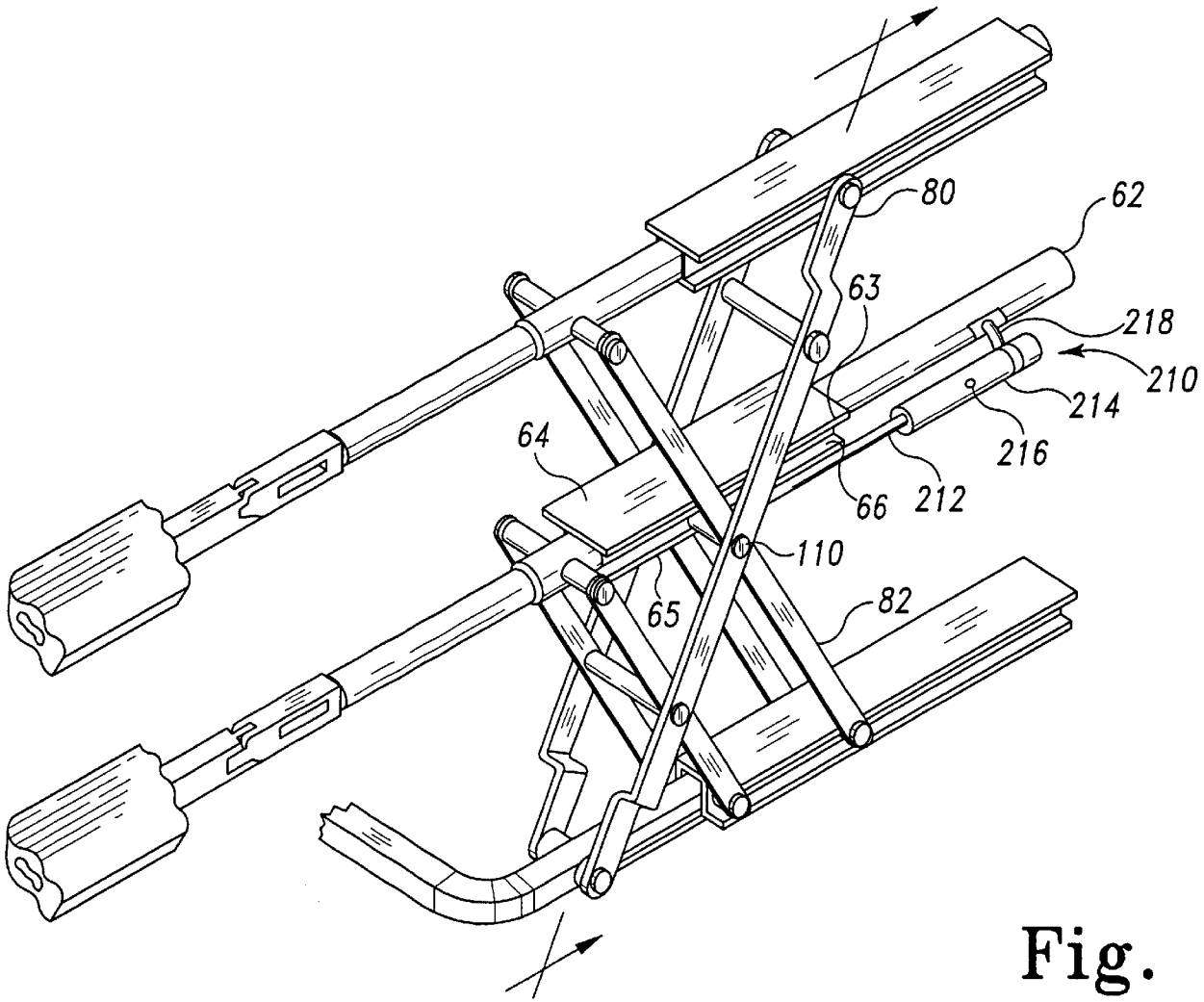
FIG. 15 is a perspective view of the lifting mechanism of FIG. 5 including a locking mechanism for holding the siderail at a desired vertical position.

The scissors lifting apparatus 26 may be locked at varying elevations. One illustrative locking mechanism 210 is shown in FIG. 15. A rod 212 is rotatably attached to bearing member 110 at one end and is inserted into receiving member 214 at the other end. Receiving member 214 is rigidly attached to second cylinder 62 by coupling 218. A mechanical detent lock 216 engages rod 212 and prevents the rod 212 from sliding in receiving member 214, which, in turn, prevents movement of first and second pairs of scissors links 80 and 82, and also prevents bearing members 110 from sliding in bearing track 66. Lock 216 is operatively associated with a release mechanism on handle 27 so that the lock 26 releases the rod 212 when the release mechanism is actuated. Accordingly, the scissors lifting apparatus 26 is illustratively vertically adjustable when the release mechanism on the handle 27 is actuated and is in a locked position when release mechanism on the handle 27 is not actuated. Other locking mechanisms can be substituted for the detent lock 216 described above, such as Mechlok® brand clutch locking mechanisms.

As will be readily appreciated by one of ordinary skill in the art, lifting mechanism 26 is not limited to a scissors-type apparatus. Lifting mechanism 26 can comprise any vertical lifting apparatus which provides horizontal movement of first and second rods 50 and 60. Similarly, rather than first and second rods 50 and 60 being slidably coupled to first and second cylinders 52 and 62, first and second rods 50 and 60 and first and second cylinders 52 and 62 are illustratively self-contained telescoping devices known in the art in another embodiment of the invention.

Figure 16:
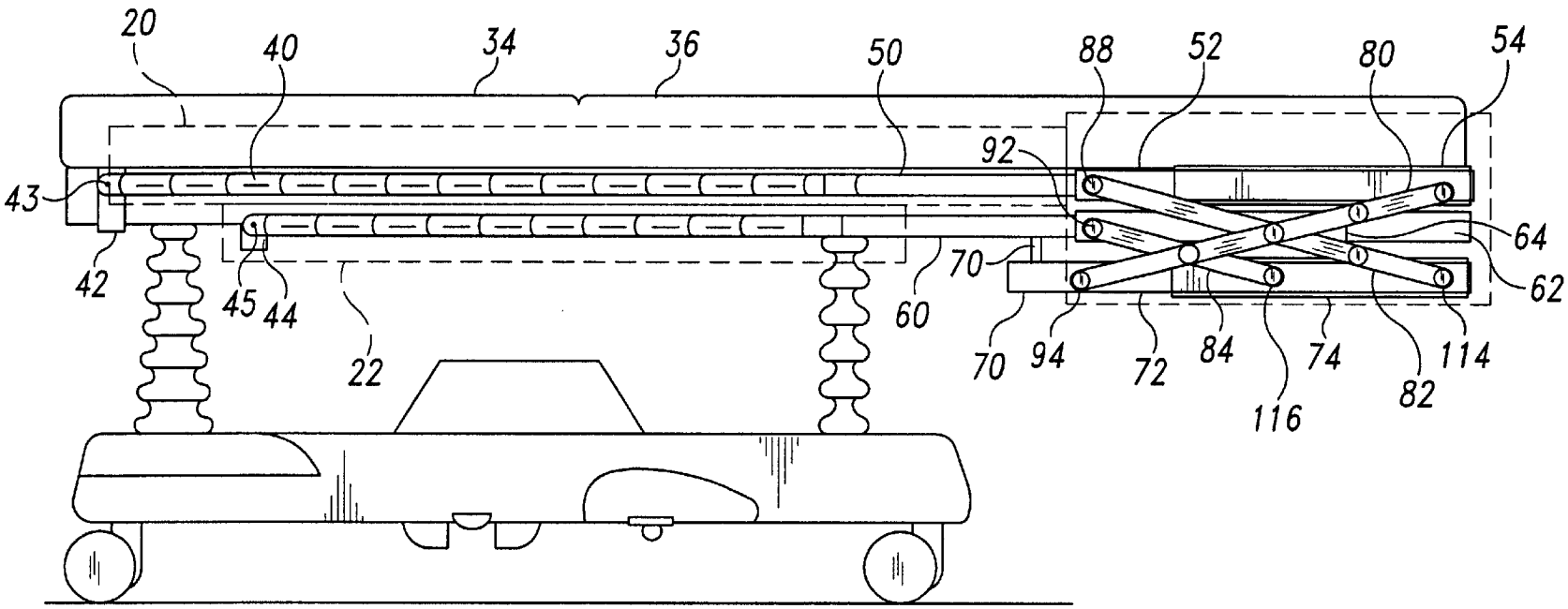
FIG. 16 is a side elevational view illustrating the flexible siderails with the lifting mechanism in a lowered position and illustrating the head deck section of the bed or stretcher in a lowered position.
Figure 17:
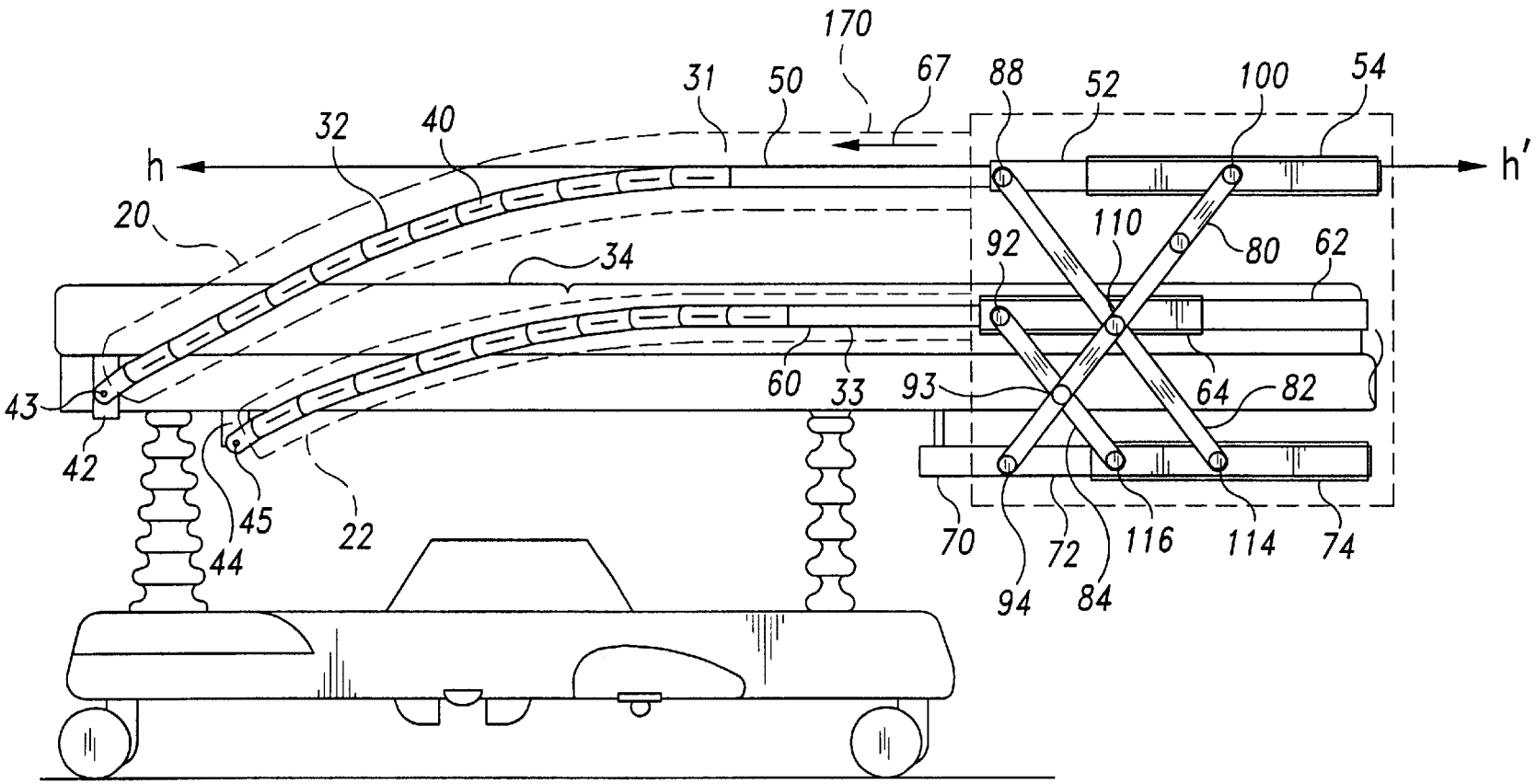
FIG. 17 is a side elevational view illustrating the flexible siderails with the lifting mechanism in a raised position and illustrating the head deck section of the bed or stretcher in a lowered position.

FIGS. 16–20 illustrate movement of the siderails 20 and 22. The plurality of interconnected links 40 coupled to rods 50 and 60 inserted into cylinders 52 and 62 accommodate flexion in first and second siderails 20 and 22. In first siderail 20 a first end link 40 of the plurality of interconnected links 40 is rotatably connected to first anchor 42 on head section 34 of the deck by pivot pin 43. An opposite end link 40 is rigidly connected to first rod 50. Likewise, in second siderail 22 a first end link 40 of the plurality of interconnected links 40 is rotatably connected to an side anchor 44 on head section 34 of the deck by pivot pin 45. An opposite end link 40 is rigidly connected to second rod 60. When the lifting mechanism 26 is raised from a lowered position as shown in FIG. 16 to a raised position as shown in FIG. 17, the links 40 articulate downward from the horizontal plane h–h'. The downward curvature is realized incrementally at each link 40 by an angle β through spacing tolerance d as described above. Alternatively, spacing tolerances d may be varied in each of the links 40 to accommodate more abrupt downward curvature in certain portions of the siderails 20, 22.

As the lifting mechanism 26 is raised, the length of first and second siderails 20 and 22 must increase to accommodate the curved articulation created by the flexion in the plurality of interconnected links 40. First rod 50 and second rod 60 extend outward from first cylinder 52 and second cylinder 62, respectively, as indicated by the arrow 67 in FIG. 17. Likewise, when the lifting mechanism 26 is lowered, the length of first and second siderails 20 and 22 must decrease to accommodate the straightening of the plurality of interconnected links 40. First rod 50 and second rod 60 move into first cylinder 52 and second cylinder 62, respectively, in a direction opposite that as indicated by the arrow 67 in FIG. 17 as the lifting mechanism 26 is lowered. Flexible and compressible siderail material 170 expands and compresses to accommodate the dynamic lengths of first and second siderails 20 and 22.

Semi-flexible rods 160 are also pivotally attached to first and second siderail anchors 42 and 44 for first and second siderails 20 and 22, respectively. Semi-flexible rods 160 limit abrupt curvature in the links 40 and also provide structural support for first and second siderails 20 and 22. Semi-flexible rod 160 may be made from a fiberglass rod, or other semi-flexible materials.

Figure 18:
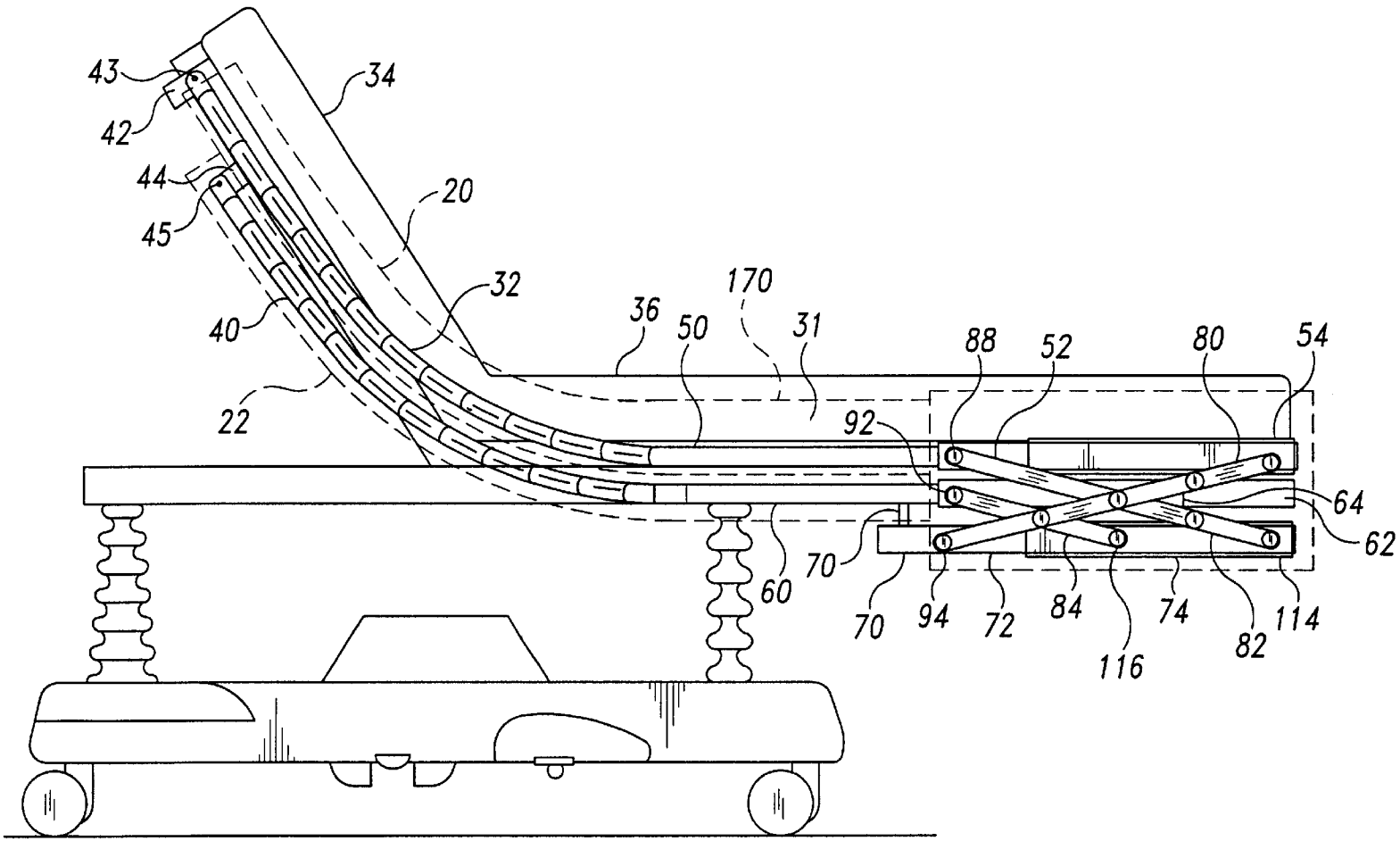
FIG. 18 is a side elevational view illustrating the flexible siderails with the lifting mechanism in a lowered position and illustrating the head deck section of the bed or stretcher in a raised position.
Figure 19:
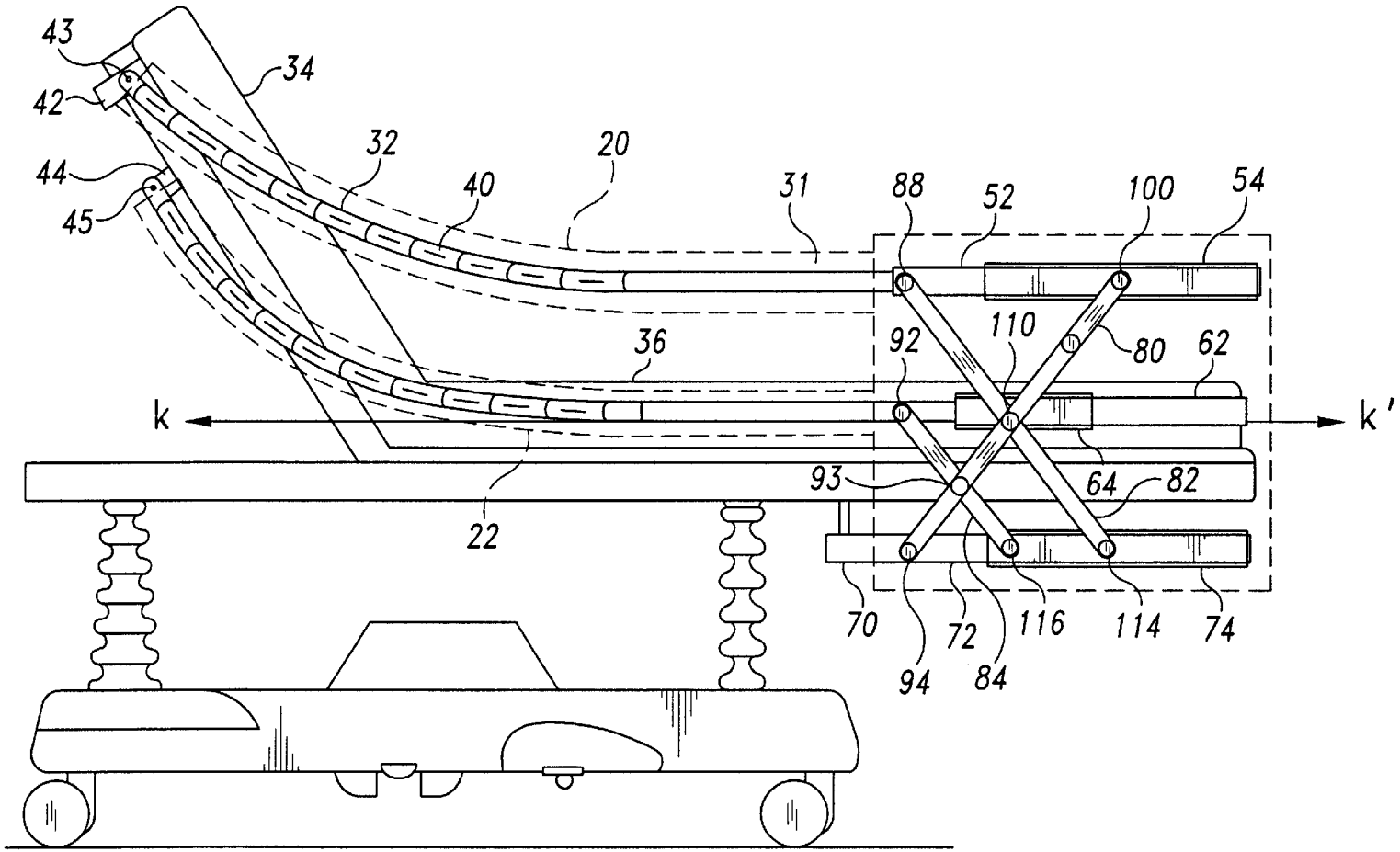
FIG. 19 is a side elevational view illustrating the flexible siderails with the lifting mechanism in a raised position and illustrating the head deck section of the bed or stretcher in a raised position.

Similar cooperation of the plurality of links 40, first and second rods 50 and 60, and first and second siderail anchors 42 and 44 occurs when the head section 34 of the deck is pivoted upwardly, and is shown in FIGS. 18 and 19. When the lifting mechanism 26 is raised from a lowered position as shown in FIG. 18 to a raised position as shown in FIG. 19, the links 40 articulate upwardly from the horizontal plane k–k'. The upward curvature is realized incrementally at each link 40 by an angle θ through spacing tolerance d as described above. Alternatively, spacing tolerances d may be varied in each of the links 40 to accommodate more abrupt downward in certain portions of the siderail. Semi-flexible rods 160 limit abrupt curvature in the links 40 and also provide structural support for first and second siderails 20 and 22.

As one of ordinary skill in the art will readily appreciate, first and second siderail anchors 42 and 44 may alternatively be coupled to an elevating section rather than the head section 34. This elevating section is illustratively configured to raise and lower concurrently with the head section. Thus, rather than having siderails 20 and 22 coupled to the head section 34, the siderail 20 and 22 are coupled to the elevating section. An elevating section includes a device that elevates vertically and is coupled to the bed frame 24 and near the top of head section 34, proximate to headboard 18, so that the siderail anchors 42 and 44 move vertically as the head section 34 is raised and lowered. Another elevating section includes a device that elevates vertically and follows an arcuate path so that the siderail anchors 42 and 44 attached thereto remain proximate to the head section 34.

Although the invention has been described in detail with reference to certain illustrated embodiments, variations exist within the scope and spirit of the invention as described and as defined in the following claims.

What is claimed is:

1. A siderail for a bed having a frame and a head deck section coupled to the frame, the head deck section being movable relative to the frame from a generally horizontal position to an elevated position, the siderail comprising an elongated flexible member having a longitudinal axis, a first end portion, and a second end portion, the first end portion being coupled to the head deck section so that the flexible member bends in a first direction relative to its longitudinal axis when the head deck section is in its elevated position.

2. The siderail of claim 1, further comprising a lifting mechanism coupled to the frame and to the second end portion of the flexible member, the lifting mechanism being configured to raise and lower the flexible member relative to the frame.

3. The siderail of claim 2, further comprising a locking mechanism coupled to the lifting mechanism and a release handle coupled to the locking mechanism, whereby actuation of the release handle releases the locking mechanism and permits movement of the lifting mechanism and the flexible member relative to the frame.

4. The siderail of claim 1, further comprising an extendible section located along the longitudinal axis of the flexible member and configured to extend and retract along the longitudinal axis of the flexible member.

5. The siderail of claim 4, wherein the extendible section comprises:

a cylinder longitudinally centered along the longitudinal axis of the flexible member; and a rod having a first end slidably inserted into the cylinder and a second end coupled to the second end portion of the flexible member.

6. The siderail of claim 1, wherein the flexible member comprises a plurality of interconnected links.

7. The siderail of claim 6, wherein each link comprises:

a body having first and second ends;

a receiver located on the first end of the body, the receiver being defined by a pair of spaced apart blocks;

an inner link plate extending outwardly from the receiver;

an outer link plate extending outwardly from the second end of the body; and a prong extending distally from the outer link plate.

8. The siderail of claim 7, wherein the inner link plate further comprising a pin coupled to the inner link plate, the pin extending perpendicularly from the inner link plate.

9. The siderail of claim 8, wherein the outer link plate defines an aperture configured to receive the pin of an adjacent link therein.

10. The siderail of claim 7, wherein the prong comprises:

a first wall extending substantially parallel to a longitudinal axis of the link; and a second wall extending at an angle α measured from the longitudinal axis of the link.

11. The siderail of claim 6, wherein each link is formed to include a bore therethrough.

12. The siderail of claim 11, further comprising a rod extending through the bores of the plurality of interconnected links.

13. The siderail of claim 12, wherein the rod is a fiberglass rod.

14. The siderail of claim 1, further comprising a siderail material extending the length of the flexible member and covering the flexible member.

15. The siderail of claim 14, wherein the flexible member includes at least one mating surface engaging the siderail material.

16. The siderail of claim 14, wherein the flexible member includes at least one mating extension engaging the siderail material.

17. The siderail of claim 14, wherein the siderail material is formed to include a plurality of compression cuts.

18. The siderail of claim 14, wherein the siderail material includes a plurality of compression regions.

19. The siderail of claim 1, wherein the lifting mechanism is a scissors lift mechanism.

20. The siderail of claim 1, further comprising a second elongated flexible member having a longitudinal axis, a first end portion, and a second end portion, the first end portion of the second flexible member being coupled to the head deck section adjacent the first end portion of the first flexible member so that the second flexible member is situated generally parallel to the first flexible member at a location below the first flexible member.

21. The siderail of claim 1, wherein the flexible member bends in a second direction relative to its longitudinal axis when the head deck section is in its generally horizontal position.

22. A siderail for a bed including a patient support surface having opposite first and second sides, a head end, and a foot end spaced apart from the head end to define a length dimension of the patient support surface therebetween, the siderail comprising first and second elongated flexible members coupled to the bed and extending along the first and second sides, respectively, the first and second flexible members extending for at least fifty percent of the length dimension of the patient support surface, and first and second lifting mechanisms coupled to the bed adjacent the first and second sides, respectively, the first and second lifting mechanisms also being coupled to the first and second flexible members, respectively, to raise and lower the first and second flexible members relative to the patient support surface.

23. The siderail of claim 22, wherein the first flexible member and first lifting mechanism cooperate to extend substantially the entire length dimension of the patient support surface and the second flexible member and the second lifting mechanism cooperate to extend substantially the entire dimension length of the patient support surface.

24. The siderail of claim 22, wherein the bed includes a frame and a head deck section coupled to the frame, the head deck section being movable relative to the frame from a generally horizontal position to an elevated position, and the first and second flexible members each has a longitudinal axis, a first end portion, and a second end portion, the first end portions being coupled to the head deck section so that the first and second flexible members bend in a first direction relative to its longitudinal axis when the head deck section is in its generally horizontal position and the flexible members bend in a second direction relative to its longitudinal axis when the head deck section is in its elevated position.

25. The siderail of claim 22, further comprising first and second locking mechanisms coupled to the first and second lifting mechanisms, respectively, each locking mechanism including a release handle coupled to the locking mechanism to release the locking mechanism.

26. The siderail of claim 22, wherein the first and second flexible members comprise a plurality of interconnected links.

27. The siderail of claim 26, wherein each link is formed to include a bore therethrough, and further comprising a rod extending through the bores of the plurality of interconnected links.

28. The siderail of claim 22, further comprising first and second covers located over the first and second flexible members, respectively.

29. The siderail of claim 22, further comprising first and second extendible sections coupled to the first and second flexible members, the first and second extendible sections being capable of extending and retracting along a longitudinal axis of the first and second flexible members, respectively.

30. A siderail for a bed having a frame, the siderail comprising:

an elevating section coupled to the frame, the elevating section having a raised position and a lowered position; and an elongated flexible member having a longitudinal axis, a first end portion, and a second end portion, the first end portion being coupled to the elevating section so that the flexible member bends in a first direction relative to its longitudinal axis when the elevating section is in its raised position.

31. The siderail of claim 30, further comprising a lifting mechanism coupled to the frame and to the second end portion of the flexible member, the lifting mechanism being configured to raise and lower the flexible member relative to the frame.

32. The siderail of claim 30, further comprising an extendible section located along the longitudinal axis of the flexible member and configured to extend and retract along the longitudinal axis of the flexible member.

33. The siderail of claim 32, further comprising a lifting mechanism coupled to the frame and to the extendible section, the lifting mechanism being configured to raise and lower the extendible section relative to the frame.

34. The siderail of claim 32, wherein the extendible section comprises:

a cylinder longitudinally centered along the longitudinal axis of the flexible member; and a rod having a first end slidably inserted into the cylinder and a second end coupled to the second end portion of the flexible member.

35. The siderail of claim 30, wherein the flexible member comprises a plurality of interconnected links.

36. The siderail of claim 35, wherein each link comprises:

a body having first and second ends;

a receiver located on the first end of the body, the receiver being defined by a pair of spaced apart blocks;

an inner link plate extending outwardly from the receiver;

an outer link plate extending outwardly from the second end of the body; and a prong extending distally from the outer link plate.

37. The siderail of claim 35, wherein each link is formed to include a bore therethrough.

38. The siderail of claim 37, further comprising a rod extending through the bores of the plurality of interconnected links.

39. The siderail of claim 38, wherein the rod is a fiberglass rod.

40. The siderail of claim 30, further comprising a siderail material extending the length of the flexible member and covering the flexible member.

41. The siderail of claim 40, wherein the siderail material included a plurality of compression regions.

42. The siderail of claim 30, wherein the flexible member bends in a second direction relative to its longitudinal axis when the elevating section is in its lowered position.

43. The siderail of claim 30, wherein the elevating section is a head deck section coupled to the frame and moveable between a generally horizontal position and an elevated position, the first end portion of the elongated flexible member being coupled to the head deck section.

* * * * *